US008626034B2

(12) United States Patent
Koike et al.

(10) Patent No.: US 8,626,034 B2
(45) Date of Patent: Jan. 7, 2014

(54) DEVELOPMENT DEVICE, AND IMAGE FORMING APPARATUS AND PROCESS CARTRIDGE INCORPORATING SAME

(75) Inventors: Toshio Koike, Tokyo (JP); Yoshiyuki Fukuda, Tokyo (JP); Yoshio Hattori, Kanagawa (JP); Atsushi Nakamoto, Kanagawa (JP); Hiroaki Okamoto, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 167 days.

(21) Appl. No.: 13/359,024

(22) Filed: Jan. 26, 2012

(65) Prior Publication Data

US 2012/0219326 A1 Aug. 30, 2012

(30) Foreign Application Priority Data

Feb. 28, 2011 (JP) ..... 2011-043371

(51) Int. Cl.
*G03G 15/08* (2006.01)

(52) U.S. Cl.
USPC ..... 399/254

(58) Field of Classification Search
USPC ..... 399/254
See application file for complete search history.

(56) References Cited

U.S. PATENT DOCUMENTS

| | | | |
|---|---|---|---|
| 7,813,680 | B2 | 10/2010 | Masuda et al. |
| 8,023,855 | B2 | 9/2011 | Hattori et al. |
| 2008/0085137 | A1 | 4/2008 | Suzuki |
| 2009/0136257 | A1 | 5/2009 | Hattori et al. |
| 2009/0245887 | A1 | 10/2009 | Masuda et al. |
| 2010/0202805 | A1 | 8/2010 | Miyoshi et al. |
| 2011/0008073 | A1 | 1/2011 | Kudo et al. |
| 2011/0058858 | A1 | 3/2011 | Fukuda et al. |
| 2011/0129262 | A1 | 6/2011 | Nakamoto |
| 2011/0150525 | A1 | 6/2011 | Fujiwara et al. |
| 2011/0217085 | A1 | 9/2011 | Hattori et al. |
| 2012/0163874 | A1 | 6/2012 | Hattori et al. |

FOREIGN PATENT DOCUMENTS

| | | |
|---|---|---|
| JP | 05-333691 | 12/1993 |
| JP | 11-174810 | 7/1999 |
| JP | 2002-268353 | 9/2002 |
| JP | 2002-372862 | 12/2002 |
| JP | 2003-323043 | 11/2003 |
| JP | 4003411 | 11/2007 |
| JP | 2008-026408 | 2/2008 |
| JP | 2009-192554 A | 8/2009 |
| JP | 2009-192962 A | 8/2009 |
| JP | 2010-197539 A | 9/2010 |

*Primary Examiner* — G. M. Hyder
(74) *Attorney, Agent, or Firm* — Harness, Dickey & Pierce, P.L.C.

(57) ABSTRACT

A development device includes a developer container, a developer bearer to carry developer to a development range, a partition dividing at least partly the developer container into a supply compartment and a collecting compartment, with an end portion of the partition facing a circumferential surface of the developer bearer, a developer supply member in the supply compartment to supply the developer to the developer bearer, and a developer collecting member in the collecting compartment above the developer supply member, to receive the developer from the developer bearer. An opening is formed in a downstream end portion of the partition in a developer conveyance direction of the developer collecting member to cause the developer to fall to the supply compartment, and a width of the opening in a direction perpendicular to the axial direction increases toward downstream in the developer conveyance direction of the developer collecting member.

10 Claims, 7 Drawing Sheets

DEVELOPMENT DEVICE, AND IMAGE FORMING APPARATUS AND PROCESS CARTRIDGE INCORPORATING SAME

CROSS-REFERENCE TO RELATED APPLICATIONS

This patent application is based on and claims priority pursuant to 35 U.S.C. §119 to Japanese Patent Application No. 2011-043371, filed on Feb. 28, 2011, in the Japan Patent Office, the entire disclosure of which is hereby incorporated by reference herein.

FIELD OF THE INVENTION

The present invention generally relates to a development device, a process cartridge, and an image forming apparatus, such as a copier, a printer, a facsimile machine, or a multi-function machine having at least two of these capabilities, that includes a development device.

BACKGROUND OF THE INVENTION

Image forming apparatuses typically include a development device to develop latent images formed on a latent image bearer (e.g., a photoreceptor) with developer, and two-component developer consisting essentially of toner (toner particles) and magnetic carrier (carrier particles) is widely used. The development device typically includes a development roller serving as a developer bearer and a developer conveyance member to transport the developer inside the development device. The developer bearer has multiple magnetic poles provided thereinside to carry developer on a rotary surface thereof (i.e., sleeve) and supplies toner included in the developer to a development range facing the latent image bearer, thereby developing the latent image formed on the latent image bearer. Additionally, such development devices typically include multiple developer conveyance members to transport developer in parallel to the rotary shaft of the developer bearer. While being circulated inside the development device, developer is supplied to the developer bearer and then collected from the developer bearer downstream from the development range in the direction of rotation of the developer bearer. In response to the amount of toner consumed in the development range, toner is supplied through a toner supply inlet to the development device and mixed with the exiting developer.

For example, JP-2010-197539-A and JP-2009-192554-A propose dividing an interior of the development device with a partition into a supply compartment from which developer is supplied to the developer bearer and a collection compartment to which the developer that has passed through the development range is collected. An edge face of the partition faces the surface of the developer bearer on a cross section perpendicular to the axial direction of the development device. When the supply compartment is divided from the collection compartment, developer having a lower toner concentration that has passed through the development range is not collected in the supply compartment. Accordingly, fluctuations in the image density of toner images formed on the latent image bearer can be limited.

Additionally, in the development devices proposed in JP-2010-197539-A and JP-2009-192554-A, the supply compartment and collection compartment vertically overlap with each other at least partly. This configuration can reduce the lateral size of the development device.

BRIEF SUMMARY OF THE INVENTION

In view of the foregoing, one embodiment of the present invention provides a development device that includes a developer container for containing two-component developer including toner and carrier, a developer bearer to carry by rotation the developer contained in the developer container to a development range facing a latent image bearer, a developer supply member to supply the developer to the developer bearer while transporting the developer in the axial direction of the developer bearer, a developer collecting member positioned above the developer supply member, to receive the developer from the developer bearer while transporting the developer in the axial direction of the developer bearer, a partition dividing at least partly the developer container into a supply compartment in which the developer supply member is provided and a collecting compartment in which the developer collecting member is provided. An end portion of the partition faces a circumferential surface of the developer bearer on a cross section perpendicular to an axial direction of the developer bearer, and an opening is formed in a downstream end portion of the partition in a developer conveyance direction of the developer collecting member to cause the developer to fall to the supply compartment. The opening is shaped so that its width, which is a length in a direction perpendicular to the axial direction of the developer bearer, increases toward downstream in the developer conveyance direction of the developer collecting member.

In another embodiment, an image forming apparatus includes a latent image bearer on which a latent image is formed, and the development device described above.

Yet in another embodiment, the latent image bearer and the development device described above are housed in a common unit casing as a process cartridge removably installable in an image forming apparatus.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF THE INVENTION

Figure 1:
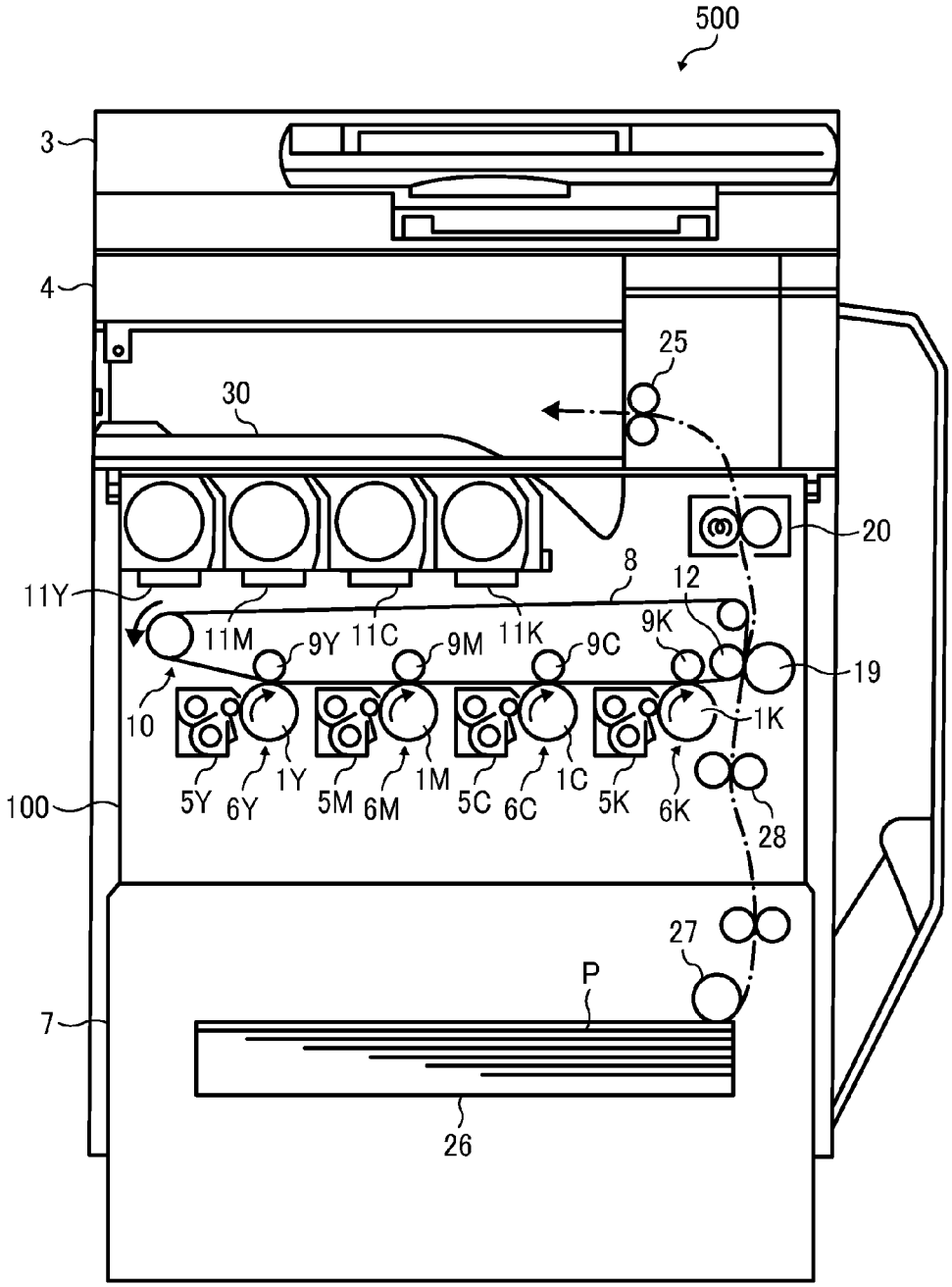
FIG. 1 is a schematic diagram illustrating an image forming apparatus according to an embodiment.

In describing preferred embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views thereof, and particularly to FIG. 1, a multicolor image forming apparatus according to an embodiment of the present invention is described.

It is to be noted that the suffixes Y, M, C, and K attached to each reference numeral indicate only that components indicated thereby are used for forming yellow, magenta, cyan, and black images, respectively, and hereinafter may be omitted when color discrimination is not necessary.

FIG. 1 is a schematic diagram that illustrates a configuration of an image forming apparatus 500 according to the present embodiment.

The image forming apparatus 500 may be, for example, a copier, and includes a printer unit 100 serving as a main body, a document reading unit 4 and a document feeder 3, both disposed above the printer unit 100, and a sheet feeding unit 7 disposed beneath the printer unit 100. The document feeder 3 feeds originals to the document reading unit 4, and the document reading unit 4 reads image data of the originals. The sheet feeding unit 7 includes a sheet cassette 26 containing sheets P of recording media (transfer sheets), and a feed roller 27 to feed the sheets P from the sheet cassette 26 to the printer unit 100. It is to be noted that broken lines shown in FIG. 1 represent a conveyance path through which the sheet P is transported inside the image forming apparatus 500.

A discharge tray 30 on which output images are stacked is formed on an upper side of the printer unit 100. The printer unit 100 includes four image forming units 6Y, 6M, 6C, and 6K for forming yellow, magenta, cyan, and black toner images, respectively, and an intermediate transfer unit 10. Each image forming unit 6 includes a drum-shaped photoreceptor 1 serving as an image bearer on which a toner image is formed, and a development device 5 for developing an electrostatic latent image formed on the photoreceptor 1 into the toner image.

The intermediate transfer unit 10 includes an intermediate transfer belt 8 and primary-transfer bias rollers 9Y, 9M, 9C, and 9K. The primary-transfer bias rollers 9 transfer the toner images from the respective photoreceptors 1 and superimpose them one on another on the intermediate transfer belt 8, thus forming a multicolor toner image.

The printer unit 100 further includes a secondary-transfer bias roller 19 to transfer the multicolor toner image from the intermediate transfer belt 8 onto the sheet P, and a pair of registration rollers 28 to adjust the timing to transport the sheet P to a secondary-transfer nip formed by the intermediate transfer belt 8 and the secondary-transfer bias roller 19 pressed against it.

The printer unit 100 further includes a fixing device 20 disposed above the secondary-transfer nip to fix the toner image on the sheet P.

Additionally, toner containers 11Y, 11M, 11C, and 11K for containing respective color toners supplied to the development devices 5 are provided inside the printer unit 100, beneath the discharge tray 30 and above the intermediate transfer unit 10.

Figure 2:
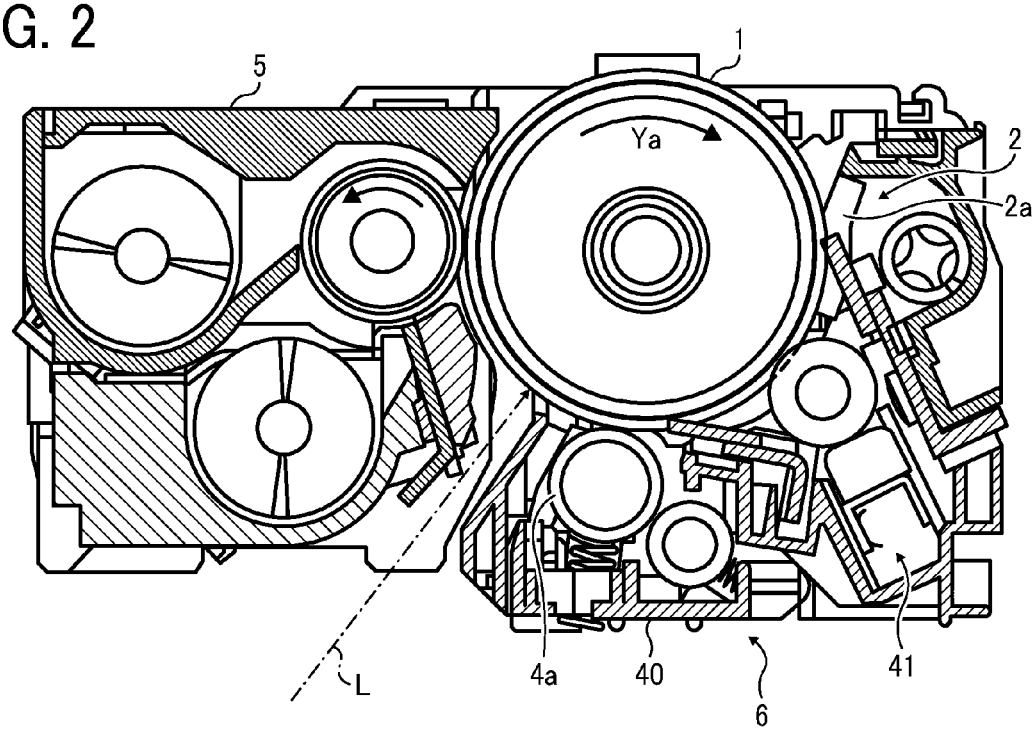
FIG. 2 is a schematic end-on axial view of an image forming unit.

FIG. 2 is an enlarged view of one of the four image forming units 6 arranged facing the intermediate transfer belt 8.

As shown in FIG. 2, the image forming unit 6 includes a cleaning unit 2, a charger 40, and a lubricant applicator 41 positioned around the photoreceptor 1 in addition to the development device 5. The components of the image forming unit 6, the photoreceptor 1, the development device 5, the cleaning unit 2, the charger 40, and the lubricant applicator 41 are removably installable in the printer unit 100. Each of them is replaced with a new one when its operational life expires.

It is to be noted that the photoreceptor 1, the development device 5, the cleaning unit 2, the charger 40, and the lubricant applicator 41, together forming the image forming unit 6, may be independent units, or alternatively, at least two of them may be housed in a common unit casing, forming a process cartridge (modular unit) removably installable in the image forming apparatus 500. When the image forming unit 6 is configured as such a process cartridge, maintenance work can be facilitated.

Operations of the image forming apparatus 500 shown in FIG. 1 to form multicolor images are described below.

When users press a start button with originals set on a document table of the document feeder 3, conveyance rollers provided in the document feeder 3 transport the originals from the document table onto an exposure glass (contact glass) of the document reading unit 4. Then, the document reading unit 4 reads image data of the original set on the exposure glass optically.

More specifically, the document reading unit 4 scans the image of the original with light emitted from an illumination lamp. The light reflected from the surface of the original is imaged on a color sensor via minors and lenses. The color sensor reads the multicolor image data of the original for each decomposed colors of red, green, and blue (RGB), and converts the image data into electrical image signals. Further, the image signals are transmitted to an image processor that performs image processing (e.g., color conversion, color calibration, and spatial frequency adjustment) according to the image signals, and thus image data of yellow, magenta, cyan, and black are obtained.

Then, the image data of yellow, magenta, cyan, and black are transmitted to an exposure unit. The exposure unit directs laser beams L to surfaces of the respective photoreceptors 1 according to image data of respective colors.

Meanwhile, the four photoreceptors 1 are rotated by a driving motor clockwise in FIGS. 1 and 2 as indicated by arrow Ya shown in FIG. 2. The surface of the photoreceptor 1 is charged uniformly at a position facing a charging roller 4*a* of the charger 40 (charging process). Thus, charge potentials are formed on the surface of each photoreceptor 1. Subsequently, the surface of the photoreceptor 1 thus charged reaches a position to receive the laser beam L.

The exposure unit includes four light sources to emit the laser beams L corresponding to the image data of respective colors, which are directed to the respective photoreceptors 1 through different optical paths for yellow, magenta cyan, and black (exposure process).

The laser beam L corresponding to the yellow component is directed to the photoreceptor 1Y that is the first from the left in FIG. 1 among the four photoreceptors 1 via multiple optical elements, deflected by a polygon minor that rotates at high velocity in a direction of a rotation axis of the photoreceptor 1Y (main scanning direction). Thus, an electrostatic latent image for yellow is formed on the photoreceptor 1Y charged by the charger 40.

Similarly, the laser beam L corresponding to the magenta component is directed to the surface of the photoreceptor 1M that is the second from the left in FIG. 1, thus forming an electrostatic latent image for magenta thereon. The laser beam L corresponding to the cyan component is directed to the surface of the photoreceptor 1C that is the third from the left in FIG. 1, thus forming an electrostatic latent image for cyan thereon. The laser beam L corresponding to the black component is directed to the surface of the photoreceptor 1K that is the fourth from the left in FIG. 1, thus forming an electrostatic latent image for black thereon.

Subsequently, the surface of the photoreceptor 1 where the electrostatic latent image is formed is further transported to the position facing the development device 5. The development device 5 contains developer including toner (toner particles) and carrier (carrier particles) and supplies toner to the surface of the photoreceptor 1, thus developing the latent image thereon (development process) into a single-color toner image.

Then, the surfaces of the respective photoreceptors 1 reach positions facing the intermediate transfer belt 8, where the respective primary-transfer bias rollers 9 are provided in contact with an inner circumferential surface of the intermediate transfer belt 8. Each primary-transfer bias roller 9 receives a transfer bias whose polarity is opposite the charge polarity of the toner. Then, the single-color toner images are transferred from the respective photoreceptors 1 and superimposed one on another on the intermediate transfer belt 8 (transfer process) in primary-transfer nips where the primary-transfer bias rollers 9 press against the photoreceptors 1 via the intermediate transfer belt 8. Thus, a multicolor toner image is formed on the intermediate transfer belt 8.

Some toner tends to remain on the surface of the photoreceptor 1 that has passed through the primary-transfer nip. When the surface of the photoreceptor 1 reaches a position facing the cleaning unit 2, a cleaning blade 2*a* collects any toner remaining on the photoreceptor 1 (cleaning process).

Subsequently, a discharger removes electrical potentials remaining on the surface of the photoreceptor 1.

Thus, a sequence of image forming processes performed on the photoreceptor 1 is completed.

Meanwhile, the intermediate transfer belt 8 carrying the superimposed single-color toner images (a multicolor toner image) transferred from the four photoreceptors 1 rotates counterclockwise in FIG. 1 and reaches a position facing the secondary-transfer bias roller 19. A secondary-transfer backup roller 12 and the secondary-transfer bias roller 19 press against each other via the intermediate transfer belt 8, and the contact portion therebetween is hereinafter referred o as a secondary-transfer nip. The multicolor toner image on the intermediate transfer belt 8 is transferred onto the sheet P (recording medium) transported to the secondary-transfer nip.

As certain amount of toner tends to remain on the intermediate transfer belt 8 after the secondary-transfer process, the belt cleaning unit removes any toner from the intermediate transfer belt 8 that has passed through the secondary-transfer nip, thus initializing the surface of the intermediate transfer belt 8. Thus, a sequence of image forming processes performed on the intermediate transfer belt 8 is completed.

The sheet P is transported from the sheet feeding unit 7 via the registration rollers 28, etc., to the secondary-transfer nip.

More specifically, the sheet cassette 26 of the sheet feeding unit 7 contains multiple sheets P piled one on another. The feed roller 27 rotates counterclockwise in FIG. 1 to feed the sheet P on the top contained in the sheet cassette 26 toward a nip formed between the registration rollers 28. When a leading edge of the sheet P reaches the nip therebetween, the registration rollers 28 suspend rotation, stopping the sheet P. The registration rollers 28 resume rotating to transport the sheet P to the secondary-transfer nip, time to coincide with the arrival of the multicolor toner image formed on the intermediate transfer belt 8. Thus, the multicolor toner image is recorded on the sheet P.

Subsequently, the sheet P is transported to the fixing device 20. In the fixing device 20, a fixing belt and a pressing roller are pressed against each other, forming a fixing nip, where the toner image is fixed on the sheet P with heat and pressure.

Then, the sheet P is transported by a pair of discharge rollers 25 and discharged outside the printer unit 100 as an output image onto the discharge tray 30. Thus, a sequence of image forming processes performed in the image forming apparatus 500 is completed.

The development device 5 is described in further detail below.

Figure 3:
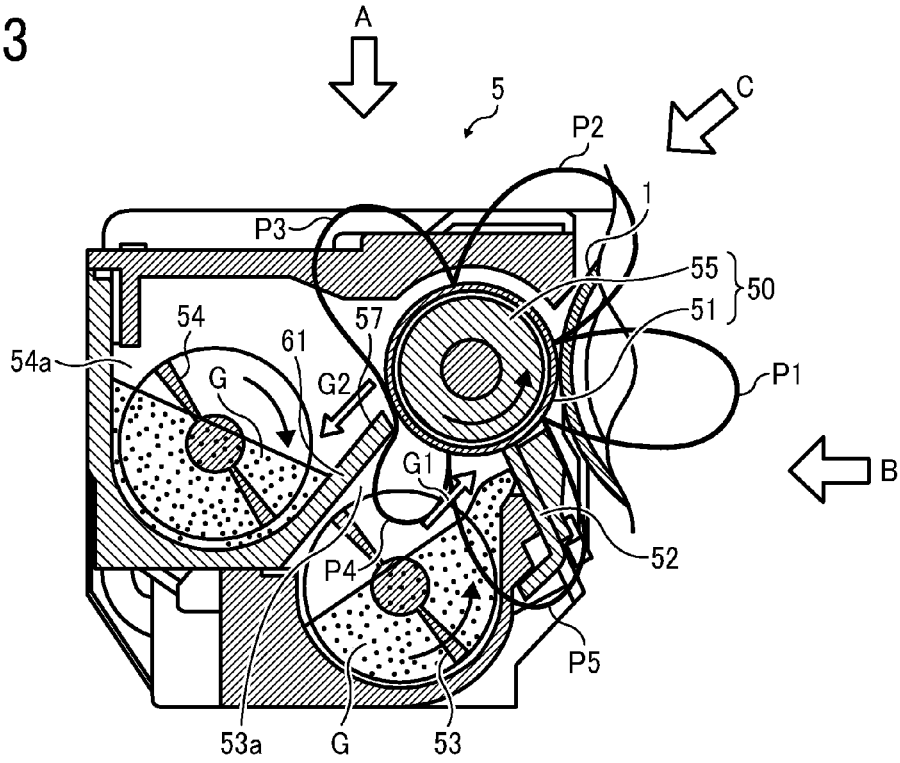
FIG. 3 is a cross-sectional view of a development device according to an embodiment.
Figure 4:
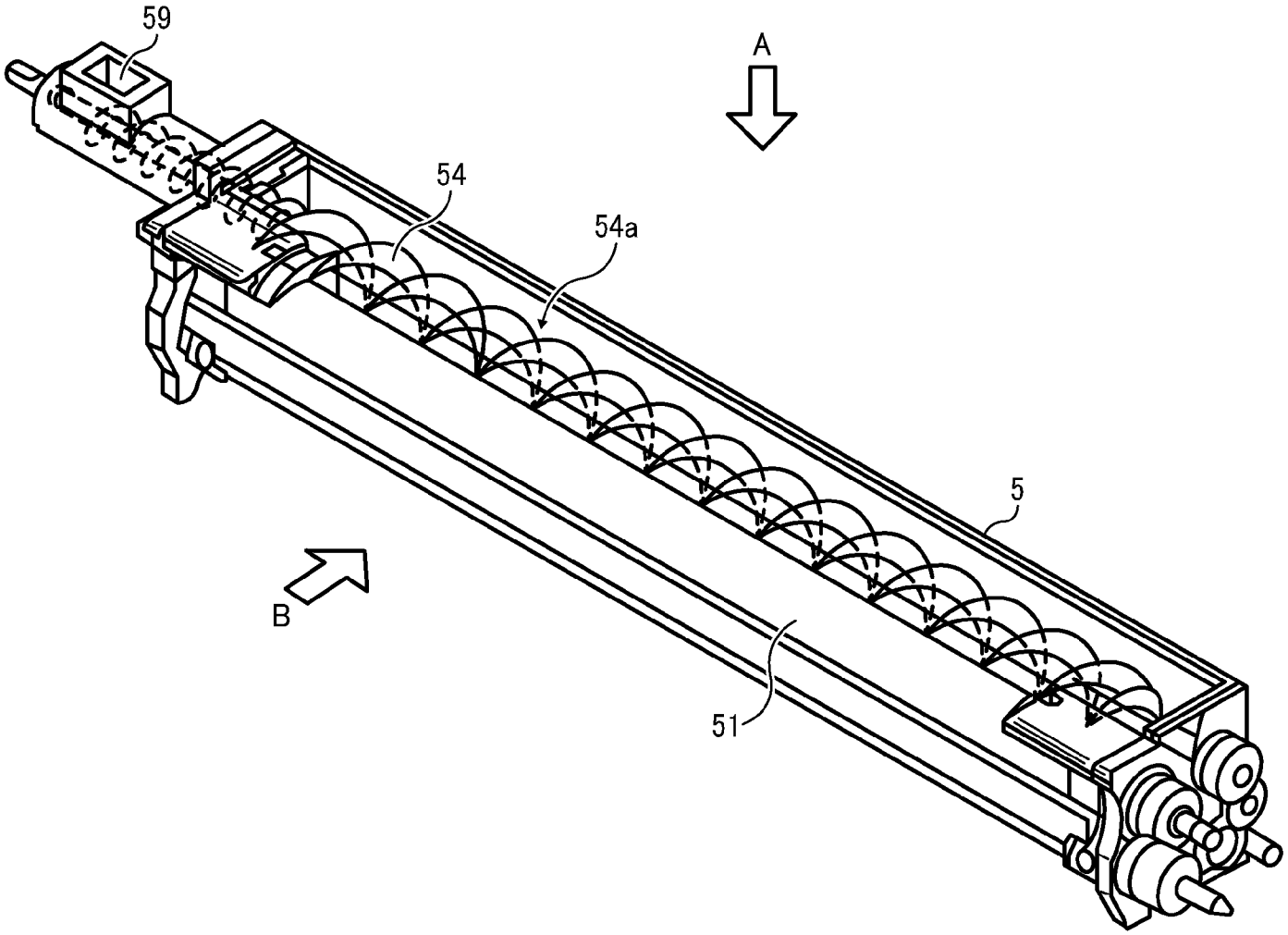
FIG. 4 is a perspective view of the development device.

FIG. 3 is a cross-sectional view of the development device 5 according to the present embodiment, and FIG. 4 is a perspective view of the development device 5 from which an upper casing is removed. It is to be noted that, in FIG. 3, reference numeral 59 represents a toner supply inlet.

The development device 5 includes a development roller 50 serving as a developer bearer disposed facing the photoreceptor 1, developer conveyance members, namely, a supply screw 53 and a collecting screw 54, a doctor blade 52, and a partition 57. The supply screw 53 and the collecting screw 54 may be screw members each including a rotary shaft and a spiral blade winding around the rotary shaft and transports developer in an axial direction by rotating.

The partition 57 divides, at least partly, an interior of a casing of the development device 5 into a supply compartment 53*a* in which the supply screw 53 is provided and a collecting compartment 54*a* in which the collecting screw 54 is provided. Additionally, on the cross section (shown in FIG. 3) perpendicular to the axial direction, an edge face of the partition 57 faces the development roller 50 and positioned adjacent to the development roller 50. Thus, the partition 57 can also serve as a separator to facilitate separation of developer G from a surface of the development roller 50.

The development roller 50 includes a magnet roller 55 including multiple magnets fixed in position relative to the casing of the development device 5 and a development sleeve 51 that rotates around the magnet roller 55. The magnet roller 55 according to the present embodiment includes, for example, five magnetic poles (first through fifth poles) P1 through P5. The first, third, and fourth pales P1, P3, and P4 are north (N) poles, and the second and fifth poles P2 and P5 are south (S) poles. It is to be noted that reference characters P1 through P5 in FIG. 3 represent density distribution (absolute value) of magnetic flux formed by the respective magnetic poles on the development sleeve 51 in a direction normal to the surface of the development sleeve 51.

Figure 5A:
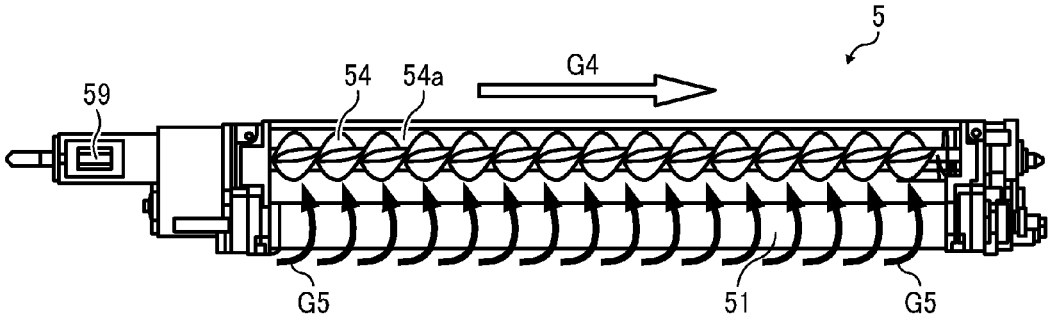
FIGS. 5A, 5B, and 5C are a top view, a front view, and a cross-sectional view of the development device as viewed in a longitudinal direction.
Figure 5B:
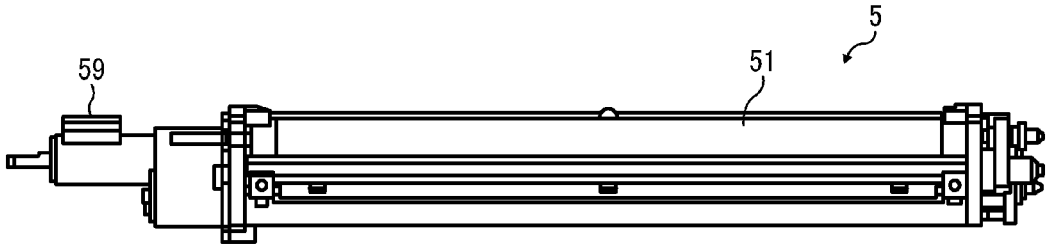
Figure 5C:
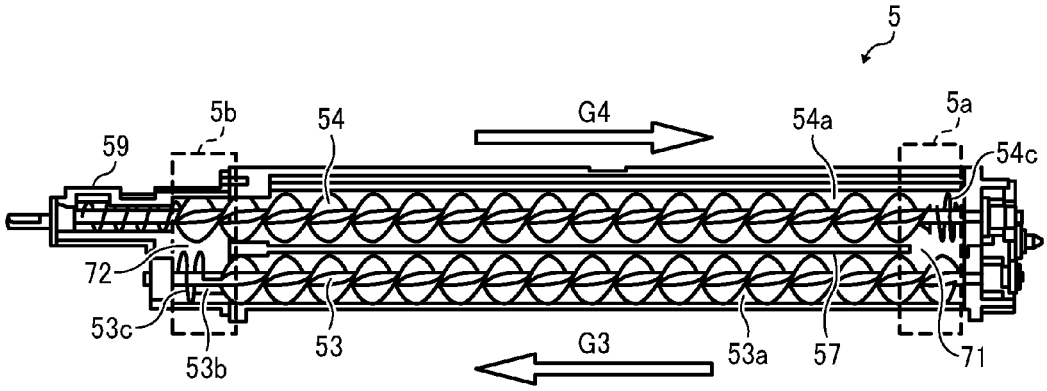

FIGS. 5A, 5B, and 5C illustrate the development device 5 as viewed in a longitudinal direction. FIG. 5A is a top view of the development device 5 from which the upper casing is removed, as viewed in the direction indicated by arrow A shown in FIGS. 3 and 4. FIG. 5B is a front view of the development device 5 as viewed in the direction indicated by arrow B shown in FIGS. 3 and 4. FIG. 5C is a cross-sectional view of the development device 5 as viewed in the direction indicated by arrow C shown in FIG. 3.

The casing of the development device 5 contains two-component developer G consisting essentially of toner and carrier (one or more additives may be included), and the development device 5 further includes a toner concentration detector to detect the concentration of toner in the developer G. As indicated by arrow G3 and G4 shown in FIGS. 5A through 5C, the supply screw 53 and the collecting screw 54 transport the developer G in the longitudinal direction (axial direction of the development sleeve 51), and thus a developer circulation path is formed inside the development device 5. Additionally, the supply screw 53 and the collecting screw 54 are arranged vertically, and the supply compartment 53*a* and the collecting compartment 54*a* are formed with the partition 57 disposed between the two developer conveyance members.

Additionally, the doctor blade 52 is provided beneath the development roller 50 in FIG. 3 and upstream in the direction of rotation of the development sleeve 51 from a development range where the development roller 50 faces the photoreceptor 1. The doctor blade 52 adjusts the amount of developer conveyed to the development range, carried on the development sleeve 51.

Further, the toner supply inlet 59 is formed in the development device 5 to supply toner to the development device 5 in response to consumption of toner because two-component developer is used in the present embodiment. While being transported, the supplied toner is agitated and mixed with the developer G exiting in the development device 5 by the collecting screw 54 and the supply screw 53. The developer G thus agitated is partly supplied to the surface of the development sleeve 51 and carried thereon. After the doctor blade 52 disposed beneath the development sleeve 51 adjusts the amount of the developer G, the developer G is transported to the development range. In the development range, toner in the developer G on the development sleeve 51 adheres to the latent image formed on the surface of the photoreceptor 1. The multiple magnets of the magnet roller 55 provided inside the development sleeve 51 generate the multiple magnetic poles P1 through P5 for forming magnetic fields around the development roller 50.

The development device 5 according to the present embodiment is filled with the developer G in which toner particles, including polyester resin as a main ingredient, and magnetic carrier particles are mixed uniformly. For example, the toner has an average particle diameter of about 5.8 μm, the magnetic carrier has an average particle diameter of about 35 μm, and the concentration of toner in the developer G is about 7% by weight. The supply screw 53 and the collecting screw 54 arranged in parallel are rotated at a velocity within a range from about 600 rpm to 800 rpm, thereby transporting the developer G and agitating the toner supplied through the toner supply inlet 59 simultaneously. Thus, the toner and carrier can be mixed uniformly in the developer G, and charge potentials are given to the toner.

While being transported by the supply screw 53 positioned adjacent to and in parallel to the development sleeve 51, the developer G in which toner and carrier are mixed uniformly is attracted by the fourth and fifth poles P4 and P5 of the magnet roller 55 inside the development sleeve 51 and carried on an outer circumferential surface of the development sleeve 51 as indicated by arrow G1 shown in FIG. 3. The developer G carried on the development sleeve 51 is transported to the development range as the development sleeve 51 rotates counterclockwise as indicated by an arrow shown in FIG. 3. The development sleeve 51 receives power from a high-voltage power source, and thus a development field (electrical field) is generated between the development sleeve 51 and the photoreceptor 1 in the development range. With the development field, toner in the developer G is supplied to the latent image formed on the surface of the photoreceptor 1, developing it.

The developer on the development sleeve 51 that has passed through the development range is collected in the collecting compartment 54*a* as the development sleeve 51 rotates. Specifically, the developer G falls from the development sleeve 51 to an upper face of the partition 57, slides down the partition 57, and then is collected by the collecting screw 54.

Figure 6:
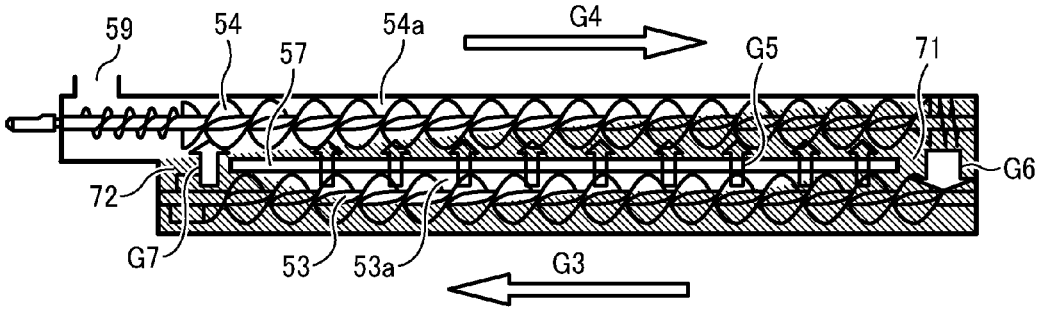
FIG. 6 is a cross-sectional view illustrating accumulation of developer inside the development device as viewed in the longitudinal direction.
Figure 7:
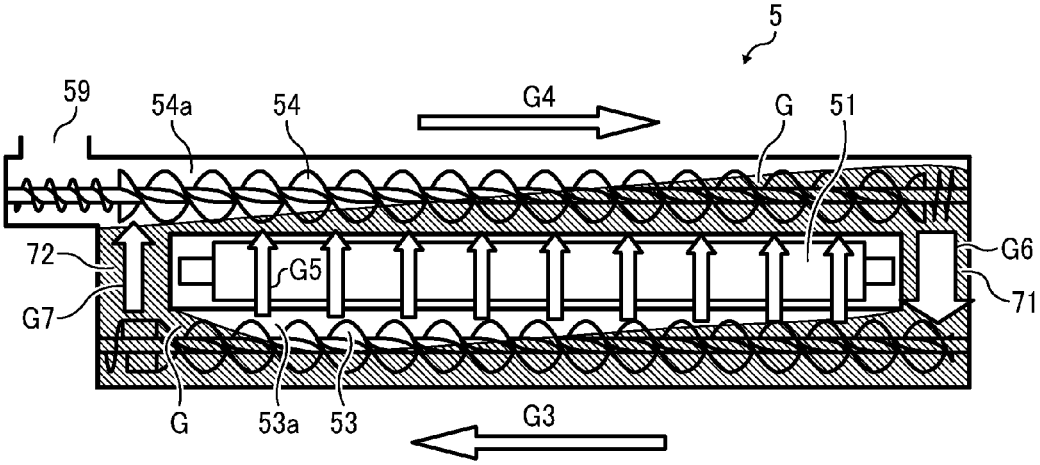
FIG. 7 is a schematic diagram illustrating movement of developer in the longitudinal direction inside the development device.

Movement and accumulation of developer G inside the development device 5 is described below with reference to FIGS. 6 and 7 that are cross-sectional views of the development device 5 as viewed in the longitudinal direction. In FIGS. 6 and 7, arrows G3 through G7 represent flow of the developer G, and hatching represents accumulation of the developer G inside the development device 5.

Arrows G3 and G4 represent flow of the developer G transported by the supply screw 53 and flow of the developer G transported by the collecting screw 54, respectively. Arrow G5 represents behavior of developer carried onto the surface of the development sleeve 51.

As shown in FIG. 6, openings, namely, a developer-falling opening 71 and a developer-lifting opening 72, are formed in end portions of the partition 57 in the longitudinal direction of the development device 5, thus forming communication portions between the supply compartment 53*a* and the collecting compartment 54*a*.

The developer G that has reached a downstream end portion of the supply compartment 53*a* in the direction in which the developer G is transported (hereinafter "developer conveyance direction") by the supply screw 53 is transported through the developer-lifting opening 41 formed in the partition 57 as indicated by arrow D7 to an upstream end portion of the collecting compartment 54*a* in the developer conveyance direction therein. The developer G that has reached a downstream end portion of the collecting compartment 54*a* in the developer conveyance direction of the collecting screw 54 is transported through the developer-falling opening 71 formed in the partition 57 as indicated by arrow D6 to an upstream end portion of the supply compartment 53*a* in the developer conveyance direction therein.

Thus, the collecting compartment 54*a* (upper compartment) and the supply compartment 53*a* (lower compartment) vertically communicate with each other in the longitudinal end portions (a developer-falling area 5*a* and a developer-lifting area 5*b* shown in FIG. 5C). In the developer-falling area 5*a*, the developer G is transported downward from the upper compartment to the lower compartment through the developer-falling opening 71. In the developer-lifting area 5*b*, the developer G is transported upward from the lower compartment to the upper compartment through the developer-lifting opening 72.

As shown in FIG. 5C, the collecting screw 54 includes a reversed spiral blade 54*c* positioned adjacent to the developer-falling area 5*a* to prevent the developer G from entering a bearing portion of the collecting screw 54 on the downstream side in the developer conveyance direction thereof. The supply screw 53 includes a reversed spiral blade 53*c* positioned adjacent to the developer-lifting area 5*b* and a paddle 53*b* positioned immediately beneath the developer-lifting opening 72 and upstream from the reversed spiral blade 53*c* in the developer conveyance direction of the supply screw 53. The reversed spiral blade 53*c* can prevent the developer G from entering a bearing portion of the supply screw 53 on the downstream side in the developer conveyance direction of the supply screw 53. The reversed spiral blade 53*c* and the paddle 53*b* can exert an upward conveyance force perpendicular to the developer conveyance direction.

It is to be noted that, although the rotary developer conveyance members in the present embodiment are screw-shaped and include spiral screw blades, the developer conveyance members are not limited thereto but may be rotary members including multiple discontinuous blades. Similarly, although reversed spiral blades 53*c* and 54*c* are used in the present embodiment, the reversed blade of the developer conveyance member, the inclination of which is reversed from the rest of the blade, is not limited thereto but may be discontinuous fins, for example.

It is to be noted that, although the supply compartment 53*a* and the collecting compartment 54*a* are illustrated as if they are away from each other in FIG. 7, it is intended for ease of understanding of supply and collection of developer from the development sleeve 51. The supply compartment 53*a* and the collecting compartment 54*a* are separated by the planar partition 57 as shown in FIGS. 3 and 6, and the developer-falling opening 71 and the developer-lifting opening 72 are through holes formed in the partition 57.

As shown in FIG. 7, the developer G in the supply compartment 53*a*, which is beneath the collecting compartment 54*a*, is pumped up to the surface of the development sleeve 51 by the rotation of the supply screw 53 as well as the magnetic force exerted from the fifth pole P5 (shown in FIG. 3), serving as a developer-lifting pole, while being transported axially by the supply screw 53. Then, the developer G carried on the development sleeve 51 passes through the development range. Downstream from the development range in the direction of rotation of the development sleeve 51 indicated by the arrow shown in FIG. 3, the third and fourth magnetic poles P3 and P4 having the same polarity (N) are provided adjacent to each other, thus forming a developer release pole to separate developer from the development sleeve 51. Accordingly, the developer G is separated from the development sleeve 51 by the magnetic force exerted from the developer release pole and the partition 57 serving as the separator and is transported to the collecting compartment 54*a*. It is to be noted the area corresponding to the developer release pole, where the developer is thus separated from the development sleeve 51, is referred to as a developer release area.

The collecting screw 54 in the collecting compartment 54*a*, which is above the supply compartment 53*a*, transports the developer G separated from the development sleeve 51 in the developer release area axially in the direction opposite the direction in which the supply screw 53 transports the developer.

The developer G transported by the supply screw 53 accumulates in the downstream end portion of the supply compartment 53*a* and moves through the developer-lifting opening 72 to the upstream end portion of the collecting compartment 54*a*, pushed by the developer transported from behind.

The toner supply inlet 59 is provided in the upstream end portion of the collecting compartment 54*a*, and fresh toner is supplied as required by a toner supply device from the toner container 11 (shown in FIG. 1) to the development device 5 through the toner supply inlet 59. The developer G transported to the downstream end portion of the collecting compartment 54*a* falls under its own weight through the developer-falling opening 71 to the upstream end portion of the supply compartment 53*a*.

As described above, the supply screw 53 and the collecting screw 54 rotate in the directions shown in FIG. 3, and simultaneously the developer is attracted to the development sleeve 51 by the magnetic attraction exerted by the magnet roller 55. Additionally, the development sleeve 51 is rotated at a predetermined velocity ratio to the velocity of the photoreceptor 1 to pump up the developer to the development range consecutively. The developer release pole formed with the third and fourth poles P3 and P4 generates a repulsive magnetic force, and the developer G transported to the developer release area is moved in a direction of a composite of normal direction and tangential direction to the rotation of the development sleeve 51.

Then, the developer separated from the development sleeve 51 falls under the gravity to the partition 57, slides down along the inclination of the upper face of the partition 57, and is collected in the area where the collecting screw 54 exerts conveyance force. At that time, the level (surface) of the developer G inside the collecting compartment 54*a* is oblique in the longitudinal direction as shown in FIGS. 6 and 7 and becomes higher toward downstream in the developer conveyance direction because the developer separated from the development sleeve 51 is collected in the collecting compartment 54*a* entirely in the axial direction of the development sleeve 51 and is transported inside the collecting compartment 54*a*.

This is a typical phenomenon in unidirectional circulation-type development devices in which the supply compartment 53*a*, from which developer is supplied to the development sleeve 51, is separated from the collecting compartment 54*a*, to which all (or almost all) the developer that has passed through the development range is collected (supply-collection separation method), as in the present embodiment.

Additionally, in the development device 5 of unidirectional circulation type, the amount of developer transported decreases toward downstream in the developer conveyance direction of the supply screw 53, and the surface of developer accumulating inside the supply compartment 53*a* is oblique similarly.

The developer G can be transported uniformly when a developer conveyance capability Wm of the supply screw 53 is greater than a developer conveyance amount Ws, which is the amount of developer conveyed on the development sleeve 51 (Wm>Ws). The conveyance capability Wm can be determined from the diameter, pitch, and rotational frequency of the supply screw 53. If this relation is not satisfied, it is possible that the amount of developer becomes insufficient on the downstream side of the supply screw 53, and the developer cannot be supplied to the development sleeve 51.

Additionally, if the bulk of the developer in the collecting compartment 54*a* is excessively large and the level is high, it is possible that the developer transported from the development sleeve 51 cannot be collected in the collecting compartment 54*a* but moves through a clearance between the partition 57 and the development sleeve 51 to the supply screw 53. In this case, the developer can be supplied to the development range before agitated sufficiently by the supply screw 53. To make the developer conveyance capability (Wm) greater than the amount of developer conveyed on the development sleeve 51 (Ws), the rotational frequency of the supply screw 53 and the collecting screw 54 are relatively high, and accordingly these screws rotate at a high velocity.

Arranging the multiple developer transport members vertically can reduce the lateral size of the development device and can reduce the entire lateral size of tandem multicolor image forming apparatuses, such as the image forming apparatus 500 shown in FIG. 1, in which multiple development devices are arranged horizontally.

Additionally, compared with a configuration in which the developer that has passed through the development range (i.e., used developer) is collected in the same developer conveyance compartment from which the developer is supplied to the developer bearer, the configuration in which the supply compartment 53*a* is divided from the collecting compartment 54*a* is advantageous in that the content of used developer in the developer carried on the development sleeve 51 to be used in image development can be smaller, and accordingly unevenness in the image density of toner images formed on the image bearer can be reduced.

Additionally, when the doctor blade 52 is positioned beneath the development sleeve 51 as in the development device 5 according to the present embodiment, the length of the sheet conveyance path from the sheet cassette 26 to the discharge tray 30 can be reduced. Thus, the first print output time in tandem multicolor image forming apparatuses can be reduced. Further, the discharge tray 30 can be positioned above the main body even if the sheet conveyance path is relatively short, and accordingly this arrangement is widely used in tandem multicolor image forming apparatuses that are horizontally compact.

However, in the above-described arrangement in which the developer collecting member is positioned above the developer supply member and the supply compartment and the collecting compartment overlap each other vertically, it is possible that the developer having a lower toner concentration that has passed through the development range fails to leave the developer bearer at the position facing the downstream end portion of the collecting compartment, or the developer once collected in the collecting compartment is not transported to the supply compartment but adheres again to the developer bearer. Such developer then passes through the clearance between the end of the partition and the developer bearer, which is the phenomenon called "carryover of developer". The following factors can be assumed to cause this phenomenon.

The used developer that has left the developer bearer downstream from the development range falls under the gravity. When the developer reaches the area in which the developer collecting member exerts the conveyance force, the used developer is circulated together with other developer in the developer conveyance compartment. As described above, the developer collecting member is positioned above the developer supply member. Therefore, the upper face of the partition, which is either horizontal or oblique, faces the collecting compartment, whereas the lower face of the partition faces the supply compartment. The developer that has reached the downstream end portion of the collecting compartment falls through the communication opening, that is, the developer-falling opening, formed in the partition to the upstream end portion of the supply compartment.

Additionally, as described above, in supply-collection separation-type development devices, the amount of developer increases toward downstream in the collecting compartment and is greatest upstream from the developer-falling opening. If the fluidity of the developer is degraded in this state, it is possible that the bulk of the developer positioned upstream from the developer-falling opening increases to contact the surface of the developer bearer. If the developer inside the collecting compartment contacts the developer bearer, the developer again adheres to the developer bearer. Thus, the developer having a reduced toner concentration can pass through the clearance between the end of the partition and the developer bearer (carryover of developer). Additionally, in a state in which the developer inside the collecting compartment is in contact with the developer bearer, the developer to be separated from the developer bearer is surrounded by the developer contained in the collecting compartment and fails to leave the developer bearer, which also results in carryover of developer.

If such developer having a lower toner concentration is transported to the development range together with the developer supplied from the supply compartment, image density becomes uneven.

In a comparative development device, the developer-falling opening is rectangular and has a uniform length in the developer conveyance direction of the developer collecting member and a uniform width, which is the length in the direction perpendicular to the developer conveyance direction.

The opening length of the developer-falling opening may be extended to prevent carryover of developer and restrict unevenness in image density when the fluidity of developer is degraded. Doing so, however, can reduce the amount of developer supplied to the downstream end of the developer-falling opening because, when the fluidity of developer is higher, the position where the developer starts falling is positioned upstream from that in the configuration in which the developer-falling opening is not extended. In the supply compartment, the downstream end of the developer-falling opening corresponds to the upstream end portion in the developer conveyance direction of the developer supply member. Therefore, if the amount of developer transported to the downstream end of the developer-falling opening is insufficient in the collecting compartment, the amount of developer supplied to the upstream end portion of the supply compartment becomes insufficient. Accordingly, on the surface of the developer bearer facing the upstream end portion of the supply compartment where the amount of developer is insufficient, the amount of developer supplied becomes insufficient.

If the developer carried on the developer bearer is insufficient, the developer bearer cannot supply a required amount of toner to the latent image bearer, making the image density lower. Thus, the image density becomes uneven.

As described above, the developer G separated from the development sleeve 51 slides down along the inclination of the upper face of the partition 57 and is collected in the area where the collecting screw 54 exerts conveyance force. At that time, the level (surface) of the developer G inside the collecting compartment 54*a* is oblique in the longitudinal direction as shown in FIGS. 6 and 7 and becomes higher toward downstream in the developer conveyance direction in unidirectional circulation-type development devices.

In particular, on the downstream side in the collecting compartment 54*a*, the level of the developer tends to be higher, and the developer tends to accumulate on the upper face of the partition 57. Then, the accumulating developer can prevent the developer falling from the development sleeve 51 from being collected in the collecting compartment 54*a*, or the accumulating developer can adhere again to the surface of the development sleeve 51. As a result, the developer to which toner is not supplied after the developer has passed through the development range is carried over to the supply compartment 53*a* positioned beneath the collecting compartment 54*a* across the partition 57.

In such a state, developer having a higher toner concentration (predetermined concentration) is supplied from the supply compartment 53*a* to the development sleeve 51 on which the developer that has passed through the development range, having a lower toner concentration, is retained. Thus, developers having different concentrations of toner are carried on the development sleeve 51. The differences in the concentration of toner can cause image density unevenness corresponding to the screw pitch of the supply screw 53.

When the fluidity of developer is degraded overtime through repeated use, the developer tends to accumulate on the upper face of the partition 57, and the increase in the bulk of developer on the downstream side in the collecting compartment 54*a* becomes noticeable. Additionally, also when the concentration of toner therein increases, the fluidity of developer decreases, and the increase in the bulk of developer on the downstream side in the collecting compartment 54*a* becomes noticeable.

Additionally, in unidirectional circulation-type development devices, it is possible that differences in the bulk of developer in the developer conveyance direction results in insufficiency of developer pumped up to the development sleeve 51 on the side of the supply screw 53, whereas carryover of developer occurs on the side of the collecting screw 54. Thus, the insufficiency of developer pumped up and carryover of developer are caused mainly because of degradation in conveyance of developer and differences in the bulk of developer in the longitudinal direction (axial direction) of the development sleeve 51.

The possibility of occurrence of carryover of developer is higher in the downstream end portion of the collecting compartment 54*a* because the amount of developer collected from the development sleeve 51 increases there in addition to the amount of developer transported by the collecting screw 54. Therefore, when the fluidity of developer decreases, the developer does not easily slides down the upper face of the partition 57. Thus, the fluidity of the developer decreases further, and the developer tends to adhere again to the development sleeve 51.

In view of the foregoing, in the present embodiment, the differences in the bulk of developer in the longitudinal direction of the development sleeve 51 can be reduced by improving the flow of developer in the downstream end portion of the collecting screw 54.

Herein, carryover of developer can be inhibited in an arrangement in which the developer supply member is positioned above the developer bearer and the developer is transported down to the collecting compartment. By contrast, in the arrangement in which developer is supplied to the developer bearer from beneath the developer bearer as in the present embodiment, the supply position at which developer is supplied to the developer bearer can be lower than the collecting position at which the developer is collected from the developer bearer, and the partition is provided as the separator to facilitate separation of developer from the developer bearer. However, depending on the condition of the developer on the partition, the developer may adhere again to the developer bearer as described above. Therefore, it is preferred to prevent carryover of developer in the downstream end portion of the respective developer conveyance compartments, particularly in the collecting compartment 54*a*, where the developer tends to accumulate and the bulk of the developer is greater.

Next, distinctive features of the present embodiment are described below.

Figure 8:
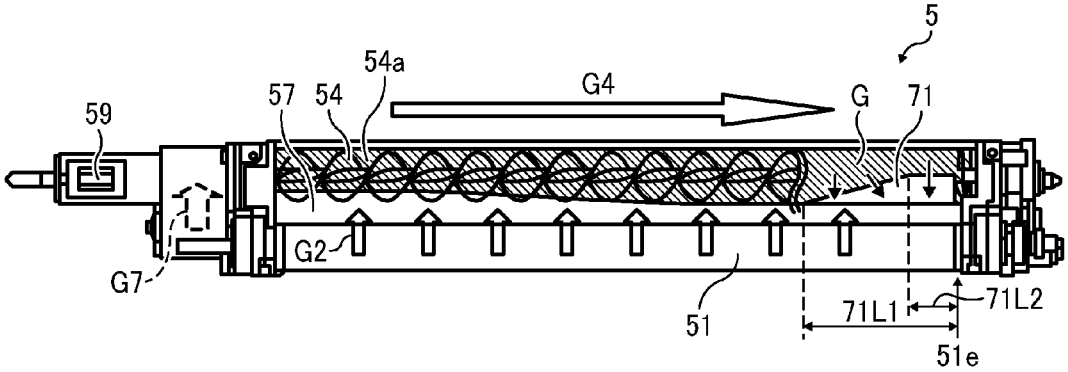
FIG. 8 is a top view of a development device according to an embodiment.

FIG. 8 is a top view of the development device 5 from which the upper casing is removed as viewed in the direction indicated by arrow A shown in FIGS. 3 and 4.

In FIG. 8, the downstream end portion of the collecting screw 54 is omitted for ease of understanding.

As shown in FIG. 8, in the development device 5 according to the present embodiment, the developer-falling opening 71 is trapezoidal and its width increases toward downstream in the developer conveyance direction of the collecting compartment 54*a*.

(Experiment 1)

Experiment 1 was executed to examine occurrence of image failure in multiple development devices among which the shape of the developer-falling opening 71 was different. To reproduce changes in the fluidity of developer, developers in which the concentration of toner was 5% by weight, 7% by weight, and 10% by weight were used. It is to be noted that the fluidity of developer is typically degraded as the toner concentration increases. Accordingly, it is assumed in this specification that the developer of toner concentration of 5% by weight, lower than that in the above-described embodiment, has higher fluidity, and the developer of toner concentration of 7% by weight, similar to that in the above-described embodiment, has a standard level of fluidity. The developer of toner concentration of 10% by weight, higher than that in the above-described embodiment, has a lower fluidity.

To evaluate occurrence of image failure, after 100 copies of an image having an image area ratio of 5% were outputted, five copies of an entire solid image were made, and the copies of the solid image were checked for image failure.

The development devices respectively including a rectangular developer-falling opening 71Z (shown in FIG. 9) and the trapezoidal developer-falling opening 71 were used. A short side 71S (shown in FIG. 9), perpendicular to the axial direction of the collecting screw 54, of the both of the rectangular developer-falling opening 71Z and the trapezoidal developer-falling opening 71 was 10 mm and is hereinafter referred to as "opening width 71S".

The longitudinal length of the rectangular developer-falling opening 71Z in the axial direction of the collecting screw 54 (an opening length), was set to 10 mm, 20 mm, and 30 mm. The trapezoidal developer-falling opening 71 had a longer side 71L1 (shown in FIG. 8) of 30 mm and a shorter side 71L2 (shown in FIG. 8) of 10 mm both in parallel to the axial direction of the collecting screw 54. It is to be noted that, reference character 51*e* shown in FIG. 8 represents an end of an area capable of carrying developer on the surface of the development sleeve 51 on the downstream side in the developer conveyance direction of the collecting screw 54 (hereinafter "sleeve end 51*e*"), and the opening length means a length from the sleeve end 51*e* to an upstream end of the developer-falling opening 71 in that direction. Although, in FIG. 8, it looks as if the downstream end of the developer-falling opening 71 in the developer conveyance direction is aligned with the sleeve end 51*e* of the development sleeve 51, the downstream end of the developer-falling opening 71 is positioned downstream from the sleeve end 51*e* in the device used in the experiment.

Evaluation results of image quality (i.e., occurrence of carryover or shortage of developer carried on the sleeve) in the four development devices among which the shape of the developer-falling opening 71 is different are shown Table 1.

TABLE 1

| | Shape and Opening Length of Developer-falling Opening | | | |
|---|---|---|---|---|
| Fluidity of Developer | Rectangular 10 mm | Rectangular 20 mm | Rectangular 30 mm | Trapezoidal 30 mm |
| Higher | Good | Shortage | Shortage | Good |
| Standard | Good | Good | Shortage | Good |
| Lower | Carryover | Good | Good | Good |

Figure 9:
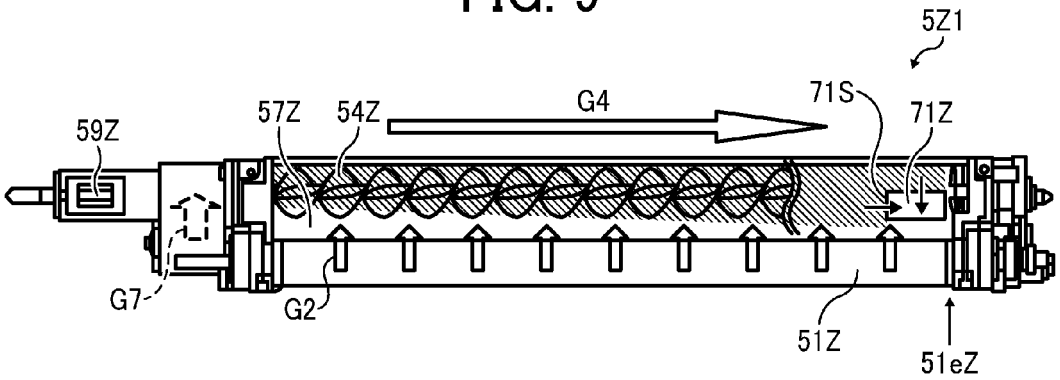
FIG. 9 illustrates a comparative development device in which an opening length of a developer-falling opening is shorter and developer of standard fluidity is contained.

FIG. 9 illustrates accumulation of developer in the comparative development device 5Z1 having the rectangular developer-falling opening 71Z whose opening length is shorter (10 mm) when developer of standard fluidity (toner concentration of 7% by weight) is used.

Figure 10:
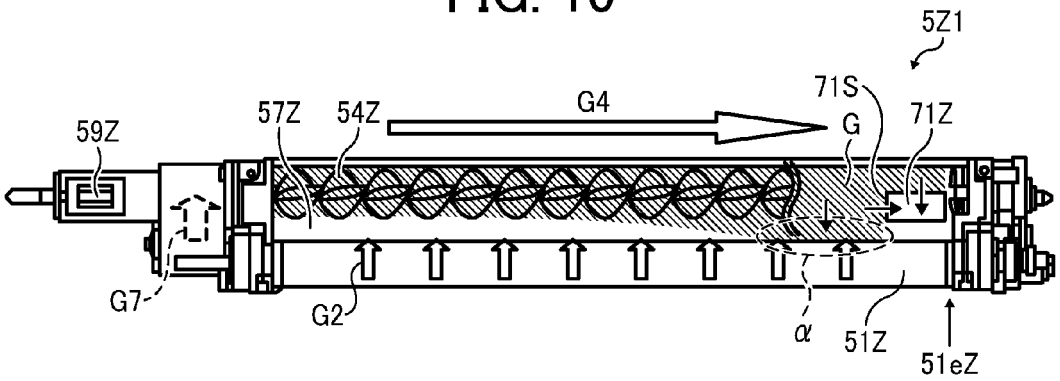
FIG. 10 illustrates the comparative development device in which the opening length of the developer-falling opening is shorter and developer of degraded fluidity is contained.

FIG. 10 illustrates accumulation of developer in the comparative development device 5Z1 shown in FIG. 9 when developer of lower fluidity (toner concentration of 10% by weight) is used.

Figure 11:
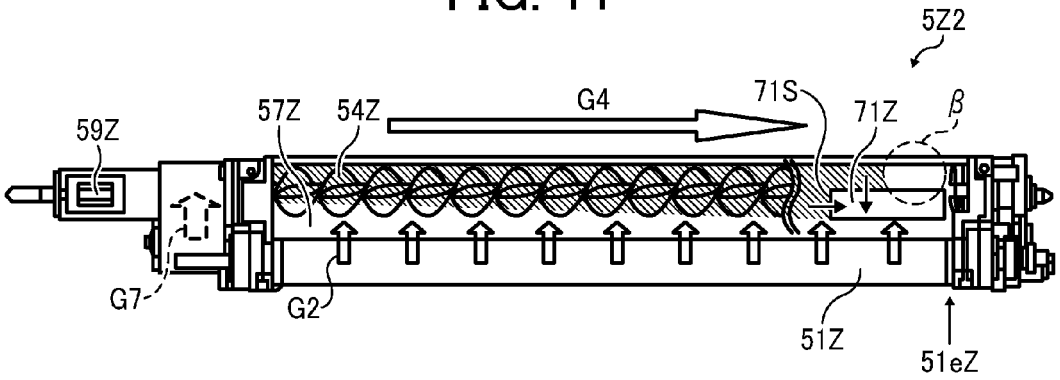
FIG. 11 illustrates a state in which developer of degraded fluidity is contained in another comparative development device in which the developer-falling opening is rectangular and the opening length is longer.

FIG. 11 illustrates accumulation of developer in the comparative development device 5Z2 having the rectangular developer-falling opening 71Z whose opening length is longer (20 mm or 30 mm) when developer of higher fluidity (toner concentration of 5% by weight) is used.

It can be known from the results shown in Table 1 that the margin of carryover is enhanced as the opening length of the developer-falling opening 71 increases. As shown in FIG. 9, even if the developer-falling opening 71Z was rectangular and its opening length was 10 mm, when the toner concentration was 7% by weight, the bulk of developer G was acceptable level and neither carryover nor shortage of developer occurred. However, as shown in FIG. 10, when the toner concentration was increased in the development device 5Z1 in which the opening length was shorter, the bulk of developer G increased to such a degree that the accumulating developer G reached to the development sleeve 51Z in an area a on the downstream side in the collecting screw 54*a*Z. Consequently, the developer separated from the development sleeve 51Z adhered again to the development sleeve 51Z and was carried over.

By contrast, as shown in Table 1, in the development device 5Z2 shown in FIG. 11 in which the opening length was longer, carryover of developer did not occur even when the toner concentration was high.

However, in the development device 5Z2 in which the opening length of the developer-falling opening 71Z is longer, when the toner concentration was lower, the bulk of developer G was smaller, and the developer G was not distributed to a position facing the sleeve end 51*e* of the development sleeve 51Z as indicated by broken circle β shown in FIG. 11. If the developer G is not present at that position, the developer G cannot be supplied to the downstream end portion of the supply compartment 53*a* positioned below the developer-falling opening 71 and facing the end sleeve end 51*e* of the development sleeve 51. Thus, shortage of developer occurred in the development device 5Z2.

By contrast, when the developer-falling opening 71 was trapezoidal as in the present embodiment, neither carryover not shortage of developer occurred.

More specifically, in the downstream end portion of the collecting compartment 54*a*, where the developer collected therein is likely to contact the surface of the development sleeve 51, the developer on the partition 57 can accumulate to a position close to the development sleeve 51 when the bulk of the developer is larger. When the developer-falling opening 71 is trapezoidal, the opening length is expanded at a position close to the development sleeve 51. Accordingly, when the bulk of the developer is greater, the developer in this configuration can start falling through the developer-falling opening 71 upstream from the position where the developer falls in the configuration in which the developer-falling opening is rectangular and the length is shorter. Thus, carryover of developer can be prevented even when the bulk of the developer is greater.

By contrast, when the fluidity of the developer is higher and the bulk of the developer is smaller, the possibility that the developer reaches the position on the partition 57 close to the development sleeve 51 is reduced adjacent to the upstream end of the trapezoidal developer-falling opening 71, thus preventing the developer from falling through the developer-falling opening 71. Additionally, the opening width 71S (the length perpendicular to the developer conveyance direction) of the trapezoidal developer-falling opening 71 decreases toward upstream in the developer conveyance direction. With this configuration, not all the developer falls on the upstream side of the developer-falling opening 71 but a necessary amount of developer can be carried to the sleeve end 51*e* as shown in FIG. 8. Thus, shortage of developer can be prevented.

Additionally, the developer-falling opening 71 can be positioned, in the direction (vertical direction in FIG. 8) perpendicular to the developer conveyance direction, in an area starting from the position of the rotary axis of the collecting screw 54 toward the development sleeve 51. In other words, a vertical position of the developer-falling opening 71 is not lower than the rotary axis of the collecting screw 54. In this configuration, the developer does not fall but can be carried to the downstream end portion of the collecting compartment 54*a* in the haft area opposite the development sleeve 51 across the rotary axis of the collecting screw 54.

As described above, in the comparative development device 5Z1, when the bulk of developer increases due to increases in the toner concentration or the like, the developer can overflow the upper end of the partition 57Z in the downstream end portion of the collecting compartment 54*a*Z, resulting in carryover of developer. By contrast, in the present embodiment in which the developer-falling opening 71 is trapezoidal, even when the bulk of developer increases, the developer can fall through the developer-falling opening 71 to the supply compartment 53*a*, thus preventing carryover of developer.

(Experiment 2)

Experiment 2 was executed to examine image quality (i.e., occurrence of image failure) in case A in which a trapezoidal developer-falling opening 71ZA (shown in FIG. 12) was positioned with the shorter (e.g., 10 mm) of opposing sides closer to the development sleeve 51 and a case B in which the trapezoidal developer-falling opening 71 was positioned with the longer (e.g., 30 mm) of opposing sides closer to the development sleeve 51. The developer-falling openings 71 and 71ZA have an identical or similar area.

Table 2 shows the results of the evaluation.

TABLE 2

| | Length of Trapezoidal Opening on Development roller Side | |
|---|---|---|
| Fluidity of Developer | Shorter (Case A: Comparative Example) | Longer (Case B: Embodiment) |
| Higher | Shortage of Developer | Good |
| Standard | Good | Good |
| Lower | Good | Good |

As shown in Table 2, in the case A in which the shorter side of the developer-falling opening 71ZA was on the side of the development sleeve 51, shortage of developer occurred when the fluidity of developer was higher. The following factors can be assumed to have caused this phenomenon.

In the case A, the side of the developer-falling opening 71ZA formed in the partition 57 away from the development sleeve 51 was longer. In such a configuration, even when the fluidity of the developer is higher and the bulk thereof is smaller, the developer falls in the upstream end portion of the developer-falling opening 71ZA, inhibiting conveyance of a sufficient amount of developer to the downstream end portion of the developer-falling opening 71ZA. Accordingly, supply of developer to the upstream end portion of the supply compartment 53*a* becomes insufficient.

Figure 12:
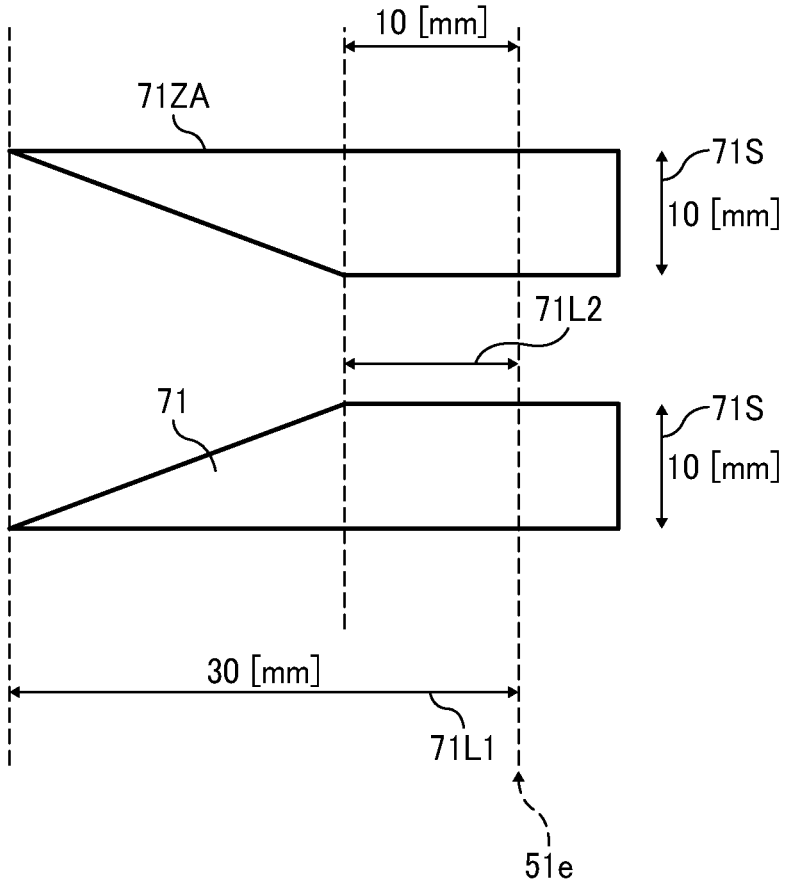
FIG. 12 illustrates developer-falling openings of development devices used in experiment 2.

Additionally, as shown in FIG. 3, in the development device 5 according to the present embodiment, the supply screw 53 is positioned obliquely beneath the collecting screw 54 so that the supply screw 53 is closer to the development sleeve 51 than the collecting screw 54 is in the lateral direction in FIG. 3. With this arrangement, an end in the width direction (perpendicular to the axial direction) of developer-falling opening 71 is close to the position on the partition 57 immediately beneath the rotary axis of the collecting screw 54. The opposite end in the width direction of the developer-falling opening 71 (on the side of the development sleeve 51) is close to the upper end of the partition 57. When the fluidity of the developer is higher and the bulk thereof is smaller, the developer does not easily reach the end of the developer-falling opening 71 on the side of the development sleeve 51. Accordingly, as shown in FIG. 12, when the end of the developer-falling opening 71 on the side of the development sleeve 51 is longer (30 mm in FIG. 12) of the parallel sides of the trapezoid, the developer can be inhibited from falling on the upstream side, enabling sufficient supply of developer to the downstream end portion of the developer-falling opening 71.

By contrast, when the fluidity of the developer is degraded and the bulk thereof increases to reach the end of the developer-falling opening 71 on side of the development sleeve 51 in the downstream end portion of the collecting compartment 54*a*, the developer reaches the height of the developer-falling opening 71 on the upstream side. Therefore, the developer can fall on the upstream side, restricting increases in the bulk of the developer and carryover of the developer.

By contrast, in the case A in which the shorter side (10 mm in FIG. 12) of the developer-falling opening 71ZA is on the side of the development sleeve 51, the opening length is longer (30 mm in FIG. 12) adjacent to the position immediately beneath the rotary axis of the collecting screw 54. The developer is present at that position (lower position) regardless of whether the bulk of the developer is large or small, and the fluidity of developer at that position is relatively good. Accordingly, at the lower position, the developer falls on the upstream side, resulting in shortage of developer.

In the configuration in which the trapezoidal developer-falling opening 71 is disposed with the longer of its opposing sides on the side of the development sleeve 51, if the longer side is too long, it is possible that the developer that has left the development sleeve 51 does not slide on the upper face of the partition 57 but immediately falls through the developer-falling opening 71 to the supply compartment 53*a*. In this case, the developer having a lower toner concentration enters the supply compartment 53*a*, resulting in density unevenness. Therefore, in the configuration shown in FIG. 12, when the longer side of the trapezoidal developer-falling opening 71 has a length of 50 mm or greater from the sleeve end 51*e*, there is a possibility of occurrence of density unevenness, and it is not desirable.

As described above, the development device 5 according to the present embodiment includes the development roller 50, the supply screw 53, and the collecting screw 54. The development roller 50 serves as the developer bearer to carry developer consisting essentially of magnetic carrier and toner on the development sleeve 51 with multiple magnetic poles of the magnet roller 55 provided inside the development roller 50. The development roller 50 transports the developer by rotation to the development range facing the photoreceptor 1 serving as the latent image bearer and supplies toner to the latent image formed thereon. The supply screw 53 serves as a developer conveyance member to transport the developer in the axial direction of the development sleeve 51 and supply it to the development sleeve 51. The collecting screw 54 serves as a developer collecting member to transport the developer that has passed through the development range in the axial direction of the development sleeve 51.

Additionally, the partition 57 separates the supply compartment 53*a* in which the supply screw 53 is provided from the collecting compartment 54*a* in which the collecting screw 54 is provided. On a cross section perpendicular to the axial direction, an end of the partition 57 faces the circumferential surface of the development sleeve 51. The collecting screw 54 is positioned above the supply screw 53 across the partition 57.

Additionally, the developer-falling opening 71 is formed in the partition 57 in the downstream end portion of the collecting compartment 54*a* in the developer conveyance direction of the collecting screw 54 so that the developer G that has reached there can fall to the supply compartment 53*a*. In the above-described development device 5, the developer-falling opening 71 is trapezoidal so that its width (71S) increases toward downstream in the developer conveyance direction of the collecting compartment 54. The opening width of the developer-falling opening 71 is narrower on the upstream side than on the downstream side in the developer conveyance direction.

Although the bulk of developer can increase adjacent to the developer-falling opening 71 when the fluidity of the developer is degraded, excessive developer can start falling farther from the downstream end by expanding the developer-falling opening 71 to the upstream side. Thus, increases in the bulk of the developer and carryover of the developer can be inhibited. When the fluidity of the developer is sufficient and the bulk of the developer is smaller, the amount of developer that falls on the upstream side can be limited because the opening width 71S of the developer-falling opening 71 is narrower on the upstream side. Thus, the amount of developer supplied to the downstream end of the developer-falling opening 71 can be sufficient. Accordingly, the amount of developer supplied to the upstream end portion of the supply compartment 53 can be sufficient, preventing shortage of developer carried on the development roller 51.

Additionally, the longer (71L1) of the opposing sides of the developer-falling opening 71 is on the side of the development sleeve 51. With this arrangement, at a position closer to the development sleeve 51, discharge of excessive developer from the collecting compartment 54*a* can be started on the upstream side. Thus, increases in the bulk of the developer closer to the development sleeve 51 and carryover of the developer can be inhibited.

Additionally, in the development device 5 according to the present embodiment, as shown in FIG. 3, the partition 57 is oblique so that its upper face (on the side of collecting compartment 54*a*) ascends toward the development sleeve 51. Therefore, in the width direction of the partition 57 (perpendicular to the axial direction), a position (end) of the partition 57 closer to the development sleeve 51 is difficult for the developer to reach when the bulk of the developer is small. When the bulk of the developer has increases to cause carryover of developer, the developer extends in the entire width of the partition 57.

In other words, the developer does not reach the position of the partition 57 closer to the development sleeve 51 until its fluidity decreases and the bulk thereof increases. In the configuration in which the longer of the opposing sides of the developer-falling opening 71 is positioned at such a position, when the bulk of the developer is greater, the developer can reach the upstream end portion of the developer-falling opening 71 and falls, thus inhibiting increases in the bulk of the developer and carryover of the developer. By contrast, when the fluidity of the developer is sufficient and the bulk thereof is smaller, the developer does not easily reach the upstream end portion of the developer-falling opening 71. Accordingly, falling of developer on the upstream side can be inhibited, enabling sufficient supply of developer to the downstream end portion of the developer-falling opening 71. Accordingly, shortage of developer carried on the development roller can be prevented.

It is to be noted that, although the description above concerns configurations in which the developer-falling opening 71 is trapezoidal, the shape of the developer-falling opening 71 is not limited thereto. Any shape is applicable as long as 1) its opening width increases toward downstream in the developer conveyance direction of the collecting screw 54, and 2) its upstream end portion is at a difficult position for the developer to reach when the fluidity of the developer is good and the bulk is small but accessible for the developer when the fluidity is degraded and the bulk increases. For example, although a straight line connects the upstream end of the shorter of the opposing sides of the developer-falling opening 71 to the upstream end of the longer of the opposing sides, alternatively, this can be curved.

The toner used in the present embodiment can have shape factors SF-1 and SF-2 both within a range of from 100 to 180. Use of such toner can secure sufficient fluidity of developer and reliable image formation without insufficiency of developer pumped up to the development roller 51 as well as carryover of developer.

Additionally, the image forming apparatus 500 according to the present embodiment includes the photoreceptor 1 serving as the latent image bearer, the charger 40 to charge the photoreceptor 1, the development device 5 to develop a latent image formed on the photoreceptor 1, and the cleaning unit 2 to remove toner remaining on the photoreceptor 1 after image transfer. The development device 5 can prevent or reduce carryover and shortage of developer carried on the developer bearer, maintaining satisfactory image density. Thus, satisfactory image formation can be attained.

Additionally, at least the photoreceptor 1 and the development device 5 can be housed in a common unit casing, forming a modular unit (process cartridge) removably installable in the apparatus body for each color. With this configuration, only the process cartridge that needs replacement, defective or the operational life thereof has expired, can be replaced independently, reducing the cost for users. This configuration can facilitate replacement of the development device 5.

Numerous additional modifications and variations are possible in light of the above teachings. It is therefore to be understood that, within the scope of the appended claims, the disclosure of this patent specification may be practiced otherwise than as specifically described herein.

What is claimed is:

1. A development device comprising:

a developer container for containing two-component developer including toner and carrier;

a developer bearer to carry by rotation the developer contained in the developer container to a development range facing a latent image bearer;

a partition dividing at least partly the developer container into a supply compartment and a collecting compartment, the partition positioned with an end portion thereof facing a circumferential surface of the developer bearer on a cross section perpendicular to an axial direction of the developer bearer;

a developer supply member disposed in the supply compartment to supply the developer to the developer bearer while transporting the developer in the axial direction of the developer bearer; and a developer collecting member disposed in the collecting compartment above the developer supply member, to receive the developer from the developer bearer while transporting the developer in the axial direction of the developer bearer, wherein an opening is formed in a downstream end portion of the partition in a developer conveyance direction of the developer collecting member to cause the developer to fall to the supply compartment, and a width of the opening in a direction perpendicular to the axial direction of the developer bearer increases toward downstream in the developer conveyance direction of the developer collecting member.

2. The development device according to claim 1, wherein the opening is trapezoidal.

3. The development device according to claim 2, wherein parallel sides of the opening are in parallel to the axial direction of the developer bearer, and a longer side of the parallel sides of the opening is on a side of the developer bearer.

4. The development device according to claim 3, wherein the partition slopes with the end portion facing the developer bearer positioned higher.

5. The development device according to claim 3, wherein the developer supply member is closer to the developer bearer than the developer collecting member is in a lateral direction perpendicular to the axial direction of the developer bearer.

6. The development device according to claim 3, wherein a vertical position of the opening is not lower than the rotary axis of the developer collecting member.

7. The development device according to claim 1, wherein the toner has a first and second shape factors SF-1 and SF-2 within a range of from 100 to 180.

8. An image forming apparatus comprising:

a latent image bearer on which a latent image is formed; and a development device to develop the latent image formed on the latent image bearer, the development device including:

a developer container for containing two-component developer including toner and carrier;

a developer bearer to carry by rotation the developer contained in the developer container to a development range facing the latent image bearer;

a partition dividing at least partly the developer container into a supply compartment and a collecting compartment, the partition positioned with an end portion thereof facing a circumferential surface of the developer bearer on a cross section perpendicular to an axial direction of the developer bearer;

a developer supply member disposed in the supply compartment to supply the developer to the developer bearer while transporting the developer in the axial direction of the developer bearer; and a developer collecting member disposed in the collecting compartment above the developer supply member, to receive the developer from the developer bearer while transporting the developer in the axial direction of the developer bearer, wherein an opening is formed in a downstream end portion of the partition in a developer conveyance direction of the developer collecting member to cause the developer to fall to the supply compartment, and a width of the opening in a direction perpendicular to the axial direction of the developer bearer increases toward downstream in the developer conveyance direction of the developer collecting member.

9. The image forming apparatus according to claim 8, wherein the latent image bearer and the development device are housed in a common unit casing removably installable in the image forming apparatus.

10. A process cartridge removably installable in an image forming apparatus, the process cartridge comprising:

a latent image bearer on which a latent image is formed; and a development device to develop the latent image formed on the latent image bearer, the development device including:

a developer container for containing two-component developer including toner and carrier;

a developer bearer to carry by rotation the developer contained in the developer container to a development range facing the latent image bearer;

a partition dividing at least partly the developer container into a supply compartment and a collecting compartment, the partition positioned with an end portion thereof facing a circumferential surface of the developer bearer on a cross section perpendicular to an axial direction of the developer bearer;

a developer supply member disposed in the supply compartment to supply the developer to the developer bearer while transporting the developer in the axial direction of the developer bearer; and a developer collecting member disposed in the collecting compartment above the developer supply member, to receive the developer from the developer bearer while transporting the developer in the axial direction of the developer bearer, wherein an opening is formed in a downstream end portion of the partition in a developer conveyance direction of the developer collecting member to cause the developer to fall to the supply compartment, and a width of the opening in a direction perpendicular to the axial direction of the developer bearer increases toward downstream in the developer conveyance direction of the developer collecting member.

* * * * *